US009425510B2

(12) United States Patent
Flores-Cuadras

(10) Patent No.: US 9,425,510 B2
(45) Date of Patent: Aug. 23, 2016

(54) COUPLED DUAL-BAND DIPOLE ANTENNA WITH INTERFERENCE CANCELLATION GAP, METHOD OF MANUFACTURE AND KITS THEREFOR

(75) Inventor: Javier Ruben Flores-Cuadras, Tijuana (MX)

(73) Assignee: TAOGLAS GROUP HOLDINGS, San Diego, CA (US)

( * ) Notice: Subject to any disclaimer, the term of this patent is extended or adjusted under 35 U.S.C. 154(b) by 559 days.

(21) Appl. No.: 13/878,209

(22) PCT Filed: Nov. 21, 2011

(86) PCT No.: PCT/US2011/061625

§ 371 (c)(1),
(2), (4) Date: Aug. 16, 2013

(87) PCT Pub. No.: WO2012/071315

PCT Pub. Date: May 31, 2012

(65) Prior Publication Data

US 2013/0321231 A1 Dec. 5, 2013

Related U.S. Application Data

(60) Provisional application No. 61/416,365, filed on Nov. 23, 2010.

(51) Int. Cl.

| | |
|---|---|
| ***H01Q 1/38*** | (2006.01) |
| ***H01Q 9/16*** | (2006.01) |
| ***H01Q 9/28*** | (2006.01) |
| ***H01Q 5/371*** | (2015.01) |

(52) U.S. Cl.

CPC ..... *H01Q 9/16* (2013.01); *H01Q 5/371* (2015.01); *H01Q 9/285* (2013.01)

(58) Field of Classification Search

USPC ..... 343/700 MS, 702, 726, 793, 795

See application file for complete search history.

(56) References Cited

U.S. PATENT DOCUMENTS

| | | | | |
|---|---|---|---|---|
| 4,136,929 | A | 1/1979 | Suzaki | |
| 6,417,816 | B2 * | 7/2002 | Sadler | H01Q 1/243 343/702 |
| 2003/0098812 | A1 | 5/2003 | Ying et al. | |

(Continued)

FOREIGN PATENT DOCUMENTS

| | | | |
|---|---|---|---|
| EP | 2538489 | A1 | 12/2012 |
| WO | 2012071266 | A2 | 5/2012 |

(Continued)

*Primary Examiner* — Hoang V Nguyen
*Assistant Examiner* — Hai Tran
(74) *Attorney, Agent, or Firm* — Shartis Friese LLP; Cecily Anne O'Regan

(57) ABSTRACT

A planar dipole antenna for dual-band Wi-Fi application is disclosed. The antenna has a ground copper and a radiation copper. The ground copper is adhered to a substrate and has an upper, shorter and generally horizontal segment and a lower, longer and also generally horizontal segment that are connected at one end thereof by a vertical segment. The radiation copper is adhered to the substrate and has a copper shaped substantially as a mirror symmetry of the ground copper and spaced apart from the ground copper by a gap at the end of the ground and radiation coppers where the shorter and longer horizontal segments thereof are connected. The antenna has a gross span of approximately 42 mm and a height of approximately 7 mm. The gap is approximately 0.6 mm.

26 Claims, 4 Drawing Sheets

(56) References Cited

U.S. PATENT DOCUMENTS

| | | | | |
|---|---|---|---|---|
| 2005/0200556 | A1 | 9/2005 | Lin et al. | |
| 2006/0038721 | A1 | 2/2006 | Ozkar et al. | |
| 2007/0115183 | A1 | 5/2007 | Kim et al. | |
| 2007/0129615 | A1 | 6/2007 | Backman et al. | |
| 2008/0129630 | A1* | 6/2008 | Baliarda | H01Q 1/36 343/793 |
| 2009/0079654 | A1* | 3/2009 | Higaki | H01Q 19/005 343/795 |
| 2009/0160717 | A1* | 6/2009 | Tsutsumi | H01Q 9/16 343/726 |
| 2011/0068996 | A1 | 3/2011 | Flores Cuadras | |
| 2012/0206301 | A1 | 8/2012 | Flores-Cuadras et al. | |
| 2012/0326943 | A1 | 12/2012 | Flores-Cuadras et al. | |

FOREIGN PATENT DOCUMENTS

| | | | |
|---|---|---|---|
| WO | WO 2012/017266 | A2 | 5/2012 |
| WO | WO 2012/071315 | A2 | 5/2012 |
| WO | WO 2012/071315 | A3 | 5/2012 |
| WO | 2012071315 | A3 | 8/2012 |
| WO | WO 2012/109067 | A2 | 8/2012 |
| WO | WO 2012/109067 | A3 | 8/2012 |
| WO | WO2012/118636 | A2 | 9/2012 |
| WO | WO2012/118636 | A3 | 9/2012 |
| WO | WO 2012/017266 | A3 | 12/2012 |

* cited by examiner

COUPLED DUAL-BAND DIPOLE ANTENNA WITH INTERFERENCE CANCELLATION GAP, METHOD OF MANUFACTURE AND KITS THEREFOR

CROSS-REFERENCE

This application claims the benefit of PCT Application No. PCT/US2011/61625 filed Nov. 11, 2011, which claims the benefit of U.S. Provisional Application No. 61/416,365, filed Nov. 23, 2010, which applications are incorporated herein by reference.

BACKGROUND OF THE INVENTION

1. Field of the Invention

The present invention relates in general to an antenna and, in particular, to a planar antenna. More particularly, the present invention relates to a coupled dual-band dipole antenna having an interference-cancellation gap for wireless applications such as Wi-Fi™, wireless HDTV, Bluetooth, Public Safety, RFID, WIMAX, tolling, remote control and unlicensed band wireless applications. The invention is suitable for use in any wireless application which uses 2400-2500 MHz and 4900-6000 MHz bands.

2. Background of the Invention

In recent years there has been a tremendous increase in the use of wireless devices. The increased use has filled all or nearly all existing frequency bands. As a result, new wireless frequency standards continue to emerge throughout the world.

Based on the IEEE 802.11 standards, Wi-Fi™ has become the de facto standard for wireless local area network (WLAN) devices, which includes cell phones, smart phones and PDA devices, and laptop and desktop personal computers. Extensive efforts have been devoted to the development of an antenna that can be used to cover the entire frequency range of the latest Wi-Fi™ standard to keep overall device costs down.

For the latest dual-band Wi-Fi antennas, increased interference is problematic in the 2.4 and 5 GHz frequency modes. It has also been difficult for a single antenna to be optimized for both frequency modes. Currently antennas are either optimized for one frequency or another or performance in both modes results in poor efficiency. Previously disclosed planar antennas include, for example, those disclosed in U.S. Pat. No. 6,917,339 B2 to Li et al. for Multi-Band Broadband Planar Antennas; U.S. Pat. No. 6,346,914 B1 to Annamaa for Planar Antenna Structure

SUMMARY OF THE INVENTION

An aspect of the disclosure is directed to planar antennas. Planar antennas typically comprise: a substrate; a conductive layer attached to a first surface of the substrate wherein the conductive layer further comprises an antenna section which includes a ground section having an upper, shorter and generally horizontal section and a lower, longer generally horizontal section connected at one end by a vertical segment, and a radiation section having a substantially mirror image shape as the ground section. Each of the antenna section and the ground section can be formed from a layer of patterned foil adhered to the first surface of the substrate. As shown, the antenna section and the ground section have a combined overall width of from about 30 mm to 58 mm and a height of from about 3 mm to about 15 mm, and more preferably the antenna section and the ground section have a combined overall width of from about 42 mm and a height of about 7 mm. Additionally, the antenna section and the ground section adhered to the substrate typically have a combined overall thickness of from about 0.05 min to about 0.15 mm, and even more preferably a combined overall thickness of about 0.1 mm. The radiation element further comprises a first horizontally longer section at a first end and a parallel shorter section below the first horizontally longer section, wherein the second section is proximal the ground element. The substrate typically is at least one of a Flame Retardant 4 material, a flexible printed circuit substrate, and a single-side printed circuit board substrate. Moreover, the conductive layer is typically selected from the group comprising copper, aluminum, nickel, silver, and chrome. An insulation layer may also be provided on top of the conductive layer. The insulation layer can be configured such that it has an aperture defining a ground access point exposing a portion of the ground element. Additionally, the insulation layer can be configured to provide an aperture defining a feed point exposing a portion of the radiation element. The dual band operation of the antenna includes, for example, a first frequency from 2400-2500 MHz and a second frequency from 4900-6000 MHz.

Another aspect of the disclosure is directed to planar antennas manufactured by patterning a substrate comprising a dielectric layer, and a conductive layer applied to at least one surface of the substrate. Planar antennas manufactured by patterning a substrate comprise: a conductive layer attached to a first surface of the substrate wherein the conductive layer further comprises an antenna section which includes a ground section having an upper, shorter and generally horizontal section and a lower, longer generally horizontal section connected at one end by a vertical segment, and a radiation section having a substantially mirror image shape as the ground section, wherein the substrate has a substantially rectangular shape. Each of the antenna section and the ground section can be formed from a layer of patterned foil adhered to the first surface of the substrate. As shown, the antenna section and the ground section have a combined overall width of from about 30 mm to 58 mm and a height of from about 3 mm to about 15 mm, and more preferably the antenna section and the ground section have a combined overall width of from about 42 mm and a height of about 7 mm. Additionally, the antenna section and the ground section adhered to the substrate typically have a combined overall thickness of from about 0.05 mm to about 0.15 mm, and even more preferably a combined overall thickness of about 0.1 mm. The radiation element further comprises a first horizontally longer section at a first end and a parallel shorter section below the first horizontally longer section, wherein the second section is proximal the ground element. The substrate typically is at least one of a Flame Retardant 4 material, a flexible printed circuit substrate, and a single-side printed circuit board substrate. Moreover, the conductive layer is typically selected from the group comprising copper, aluminum, nickel, silver, and chrome. An insulation layer may also be provided on top of the conductive layer. The insulation layer can be configured such that it has an aperture defining a ground access point exposing a portion of the ground element. Additionally, the insulation layer can be configured to provide an aperture defining a feed point exposing a portion of the radiation element. The dual band operation of the antenna includes, for example, a first frequency from 2400-2500 MHz and a second frequency from 4900-6000 MHz.

Still another aspect of the disclosure is directed to an antenna kits which include one or more antennas. Antenna kits comprise: a planar antenna comprising a substrate a conductive layer attached to a first surface of the substrate wherein the conductive layer further comprises an antenna section which includes a ground section having an upper, shorter and generally horizontal section and a lower, longer generally horizontal section connected at one end by a vertical segment, and a radiation section having a substantially mirror image shape as the ground section. Additionally, the kits can include other components such as a flexible cable adaptable to connect the planar antenna to a target device, and a planar antenna mounting material.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIG. 1*a* illustrates a top planar view of the antenna; FIG. 1*b* illustrates a cross-sectional side view along the lines 1*b*-1*b* of FIG. 1*a*; FIG. 1*c* illustrates a cross-sectional side view along the lines 1*c*-1*c* of FIG. 1*a*; FIG. 1*d* illustrates a cross-sectional side view along the lines 1*d*-1*d* of FIG. 1*a*; FIG. 1*e* illustrates an expanded view of the substrate and antenna layers;

DETAILED DESCRIPTION OF THE INVENTION

The disclosure provides a coupled dual-band dipole antenna that has cancelled electromagnetic interference suitable for use in any wireless application which uses 2400-2500 MHz and 4900-6000 MHz bands. Wireless applications include, for example, Wi-Fi™, wireless HDTV, Bluetooth, Public Safety, RFID, tolling, remote control and unlicensed band wireless applications.

Wi-Fi™ is a trademark of the Wi-Fi Alliance and typically refers only to a narrow range of connectivity technologies including wireless local area networks (WLAN) based on the IEEE 802.11 standards, device-to-device connectivity (such as Wi-Fi peer-to-peer), and a range of technologies that support personal area networks (PAN), local area networks (LAN) and WAN connections. Wi-Fi has become a superset of IEEE 802.11.

As will be appreciated by those skilled in the art, the disclosure herein enables a coupled dual-band dipole antenna with interference cancelling. The antenna is adapted and configured to cancel electromagnetic interference. Thus, antennas can operate in a dual-band mode while being simultaneously optimized to efficiently perform in two modes during operation. A planar dipole antenna is disclosed that provides for dual-band wireless application which operate in the 2400-2500 MHz and 4900-6000 MHz bands. The antennas comprise a ground section and a radiation section. The ground section can be adhered to a substrate and is shaped to have an upper, shorter and generally horizontal segment and a lower, longer and also generally horizontal segment that are connected at one end by a vertical segment. The radiation section is adhered to the substrate and has an approximate shape that is substantially a mirror image about the z axis of the ground section and is spaced from the ground section by a gap at the end of the ground section and radiation section where the shorter and longer horizontal segments thereof are connected

I. Antennas

Figure 1A:
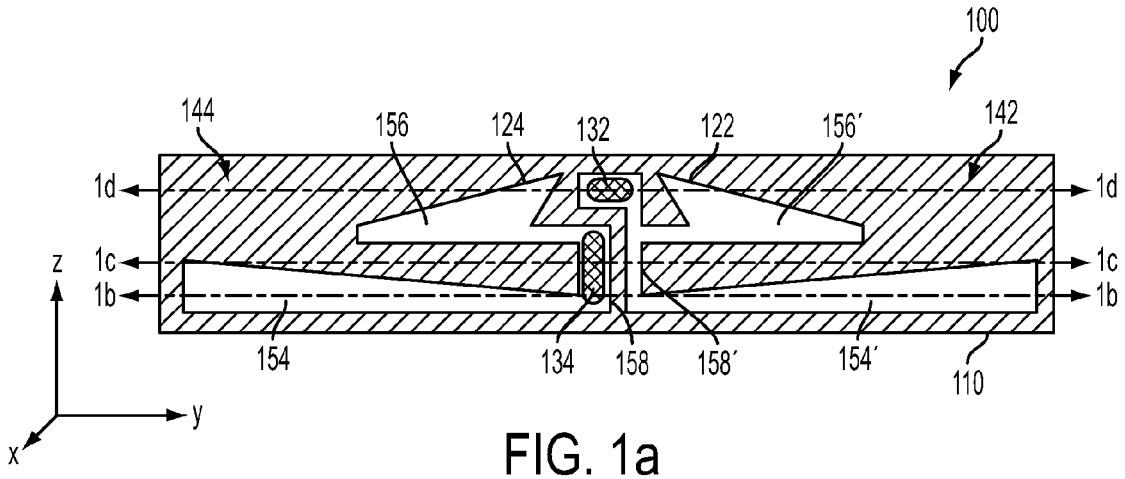
FIGS. 1*a-e* illustrate a planar antenna in accordance with the disclosure.

FIG. 1*a* illustrates a top view of a planar antenna. The antenna 100 has a planar antenna. As is illustrated, the antenna 100 has a ground element section 144 and an antenna section 142. Each of these sections with its electrically conductive layer of a correspondingly specific shaping is, typically, a layer of copper foil adhered to the surface of a suitable substrate 110.

The ground element 124 of the ground section 144 can further be masked by a protective layer 150 leaving only a ground access point 134 exposed. Similarly, the radiation element 122 of the antenna section 142 can be adapted and configured to provide an unmasked feed point 132. The ground access point 134 and feed point 132 can provide a location for the antenna to achieve an electrical connection to the antenna circuitry of the electronic equipment relying on the antenna for electromagnetic signal transmission and reception. The radiation element 122 is adhered to the substrate 110 and has an approximate shape that is substantially a mirror image about the z axis, essentially bisecting the length of the antenna, of the ground element 124 and is spaced from the ground section 144 by a gap at the end of the ground section 144 and radiation section 142 where the shorter horizontal section 156, 156' forming a perpendicular arm between two parallel sections of the ground section 144 and the antenna section 142 and the longer horizontal segment 154, 154' are connected by corresponding vertical section 158, 158'. The ground element 144 is formed in a plane and has a first section in the shape of a truncated arrowhead, wherein the arrowhead portion is cut in half along its long axis, and a second section having a tapered rectangular shape forming a partial right triangle. The two sections of the ground element 144 are connected by a perpendicular arm section or vertical section 158 which connects the two sections at one end. The antenna section 142 has a first section in the shape of a truncated arrowhead, wherein the arrowhead portion is cut in half along its long axis, and a second section having a tapered rectangular shape forming a partial right triangle. The two sections of the antenna section 142 are connected by a perpendicular arm section or vertical section 158' which connects the two sections at one end. The vertical section 158 of the ground element 144 is adjacent the vertical section 158' of the antenna section 142.

Figure 1B:
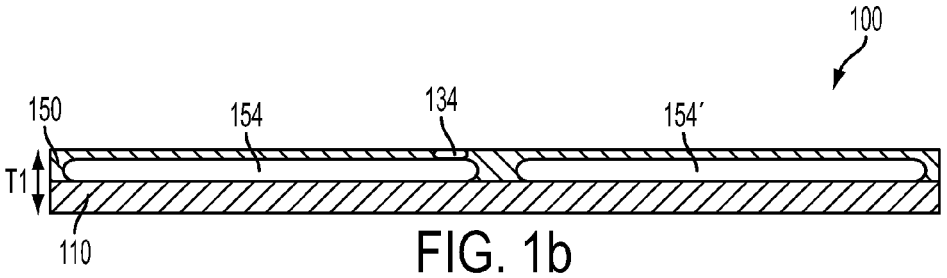
Figure 1C:
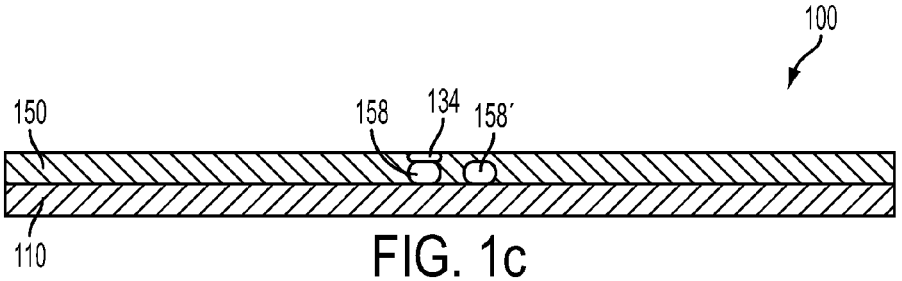
Figure 1D:
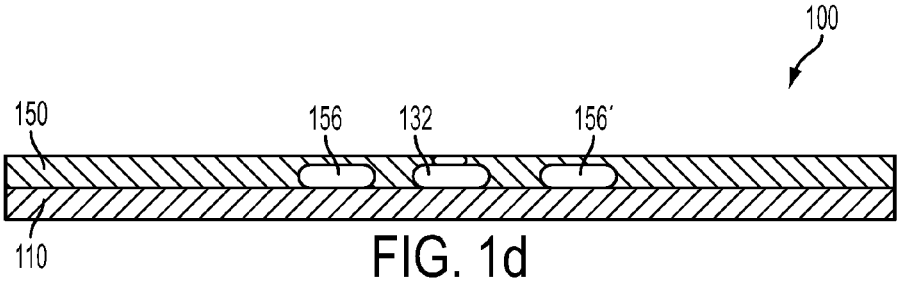

Turning now to FIGS. 1*b-d*, a substrate 110 is provided upon which the antenna element sits. A top insulation layer 150 can also be provided to electrically isolate, or selectively electrically isolate, the antenna element from the surrounding area. As shown in FIG. 1*b*, which is a cross-section of the antenna taken along the lines 1*b*-1*b* of FIG. 1*a*, the longer horizontal segments 154, 154' of the radiation element 122 and ground element 124 of the antenna sit atop the substrate 110 and are covered by an insulation layer 150. As ground access point 134 is exposed on the ground element 124. As can be seen in the cross-section shown in FIG. 1*c*, which is a cross-section of the antenna taken along the lines 1*c*-1*c* of FIG. 1*a*, the entire surface of the substrate 110 is covered by the insulation layer 150 and ground access point 134 is exposed over a narrower section along the vertical section 158 of the ground element 124 while radiation element 122 along the vertical section 158' is not exposed. Turning now to the cross-section shown in FIG. 1*d*, an opening in the insulation layer 150 is provided which provides a feed point 132 to the radiation element 122 and the shorter horizontal sections 156, 156' of the ground element 124 and the radiation element 122 are covered by insulation. The overall thickness T1 of the antenna ranges from 0.05 mm to 0.15 mm and more preferably about 0.1 mm.

Figure 1E:
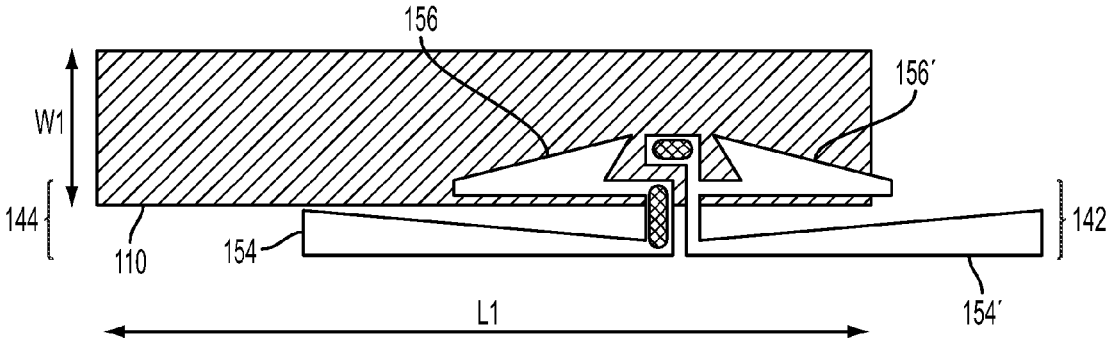

Turning now to FIG. 1*e*, the ground element 124 and radiation element 122 of suitable material, such as copper, is sized to be positioned on a substrate 110. The overall dimensions of the combined ground element 124 and radiation element 122 is L1 along one axis and W1 along a second access, where L1 typically ranges from 30 mm to 58 mm, more preferably from 40 mm to 45 mm, and even more preferably about 42 mm, and W1 typically ranges from 3 mm to 15 mm, more preferably from 5 mm to 9 mm, and even more preferably about 7 mm. The overall dimensions of the antenna is generally rectangular.

Figure 2:
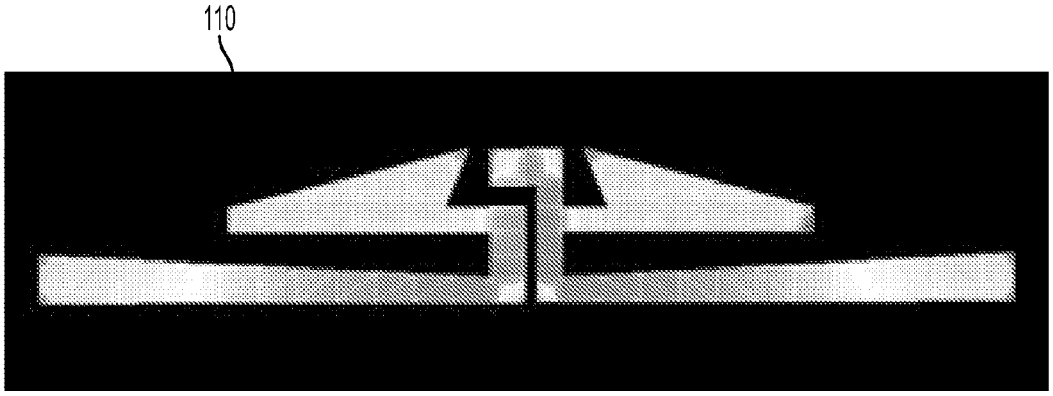
FIG. 2 shows the simulation result of current distribution for the antenna of FIGS. 1*a-e* working in the 2.4 GHz Wi-Fi mode.
Figure 3:
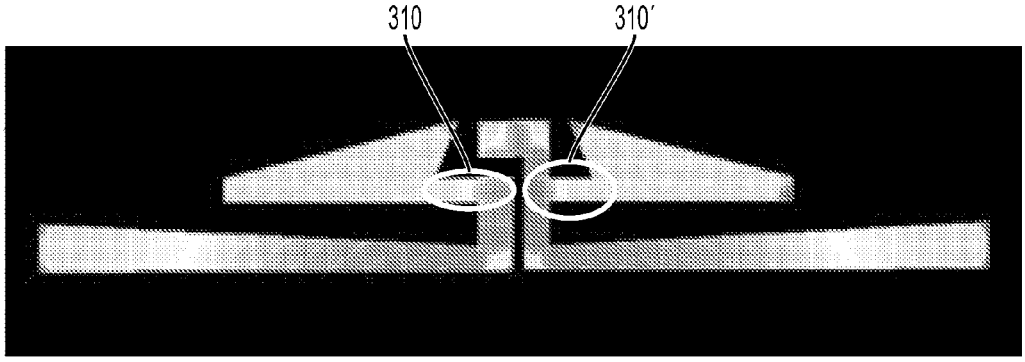
FIG. 3 shows the simulation result of current distribution for the antenna of FIGS. 1*a-e* working in the 5 GHz Wi-Fi mode.

FIG. 2 shows the simulation result of current distribution for an antenna constructed according to FIGS. 1*a-e* wherein the antenna is operating in a 2.4 GHz Wi-Fi mode. FIG. 3 shows the simulation result of current distribution for an antenna of FIGS. 1*a-e* operating in a 5 GHz Wi-Fi mode. Inductive circles 310, 310' show in FIG. 3 illustrate the greatest current that is closely related to antenna impedance matching.

Figure 4:
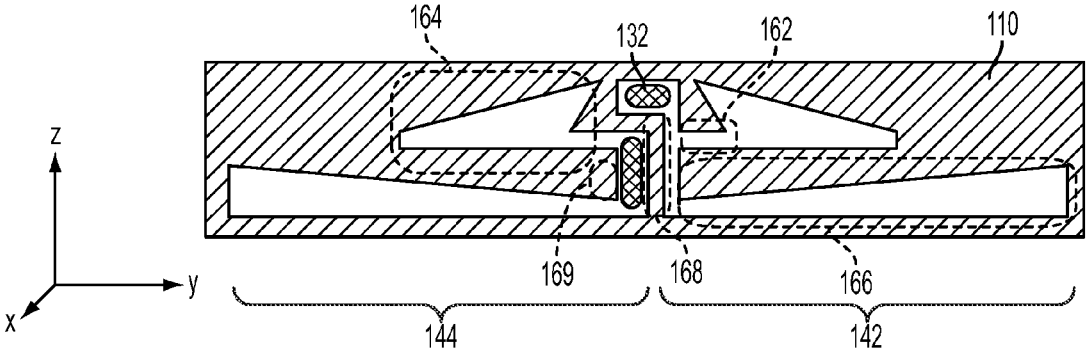
FIG. 4 illustrates an antenna segment responsible for characteristic adjustments of the antenna of FIGS. 1*a-e;*

FIG. 4 illustrates the antenna segments responsible for characteristics adjustment of the antenna of FIGS. 1*a-e*. According to the present invention, physical dimensions of several radiation control sections of the antenna copper patterning can be used as control factors for performance adjustment of antenna 100. For example, radiation control sections generally indicated by phantom-lines 162, 164, 166. The ground element 124 has a distance 169 between the adjacent the vertical section 158 of the short and long horizontal segments of the ground element 124, as well as spacing 168 between the radiating element 122 and the ground element 124 which can be used as control factors for the performance adjustment of antenna 100. Performance characteristics include, for example, the operating frequency bandwidth, the antenna electrical characteristics, and operating efficiency. These characteristics can be tweaked for the 2.4 and 5 GHz bands of the antenna 100 applications.

In one example, dimensioning of the radiation control section 162, a horizontal copper section from which the main copper of the upper segment of the radiating element 122 extends away from a symmetric centre of the antenna 100, can be altered to facilitate the antenna impedance matching for the 5 GHz mode of operation.

In another example, width of the radiation control section 164, which is substantially the radiating element of the antenna, affects the distribution of the antenna bandwidth that is targeted at 4.5~6.5 GHz.

Moreover, the width of the radiation control section 166, substantially the entire lower segment of the radiating element 122 of the antenna 100, can be altered to facilitate the settlement of the antenna center frequency as well as the bandwidth in the 2 GHz mode of operation.

The width of the radiation control section 168, which is a distance, or gap, between the radiating element 122 and the ground element 124 of the antenna, governs the antenna efficiency. In principle, the smaller the width of section 168 the better the antenna performs. Increased performance features result from of the effect of electromagnetic (EM) wave cancellation due to the presence of this gap. Such EM cancellation reduces antenna transmission loss. In a preferred embodiment of the present invention, the width of the this radiation control section 168 (the gap between the two radiating segments of the antenna) is about 0.6 mm.

Meanwhile, length of the radiation control section 169, the distance between the upper segment 156 and lower segment 158 of either the radiating element 122 or the ground element 124 of the antenna 100, is a factor to control the mutual interference between the 2 GHz and the 5 GHz bands of the antenna. It also affects the antenna overall bandwidth as well as efficiency. In general, the smaller this length (or, the closer together the two horizontal segments of the antenna copper) the lower the antenna efficiency.

II. Operation and Use of the Antennas

The antenna can be provided with a flexible cable adapted and configured to connect the antenna to the electronics of the target device, such as a mobile phone. Alternatively, the antenna can be configured such that no cable is required to connect the antenna to the target device. For a cable-less antenna, pads are provided on the antenna which provide connections from a module or transmission line via metal contacts or reflow solder.

The antenna can be affixed to a housing of a target device, such as an interior surface of a cell phone housing. Affixing the antenna can be achieved by using suitable double sided adhesive, such as 3M™ Adhesive Transfer Tape 467 MP available from 3M.

As will be appreciated by those skilled in the art, the larger the antenna surface area (or volume), in general the higher the performance in terms of gain and radiation characteristics. Additionally, the gain of the antenna is closely linked to the surface area or volume of the antenna. Thus, the larger the surface area or volume, the higher the gain. In deploying the antenna, clearances can be provided to optimize performance of the antenna. As will be appreciated by those skilled in the art, the larger the clearance, the better the radiation characteristics of the antenna.

III. Method of Manufacturing the Antennas

The features and functions of the antennas described herein allow for their use in many different manufacturing configurations. For example, in a wireless communication handheld device (e.g. a mobile phone), an antenna can be printed on any suitable substrate including, for example, printed circuit boards (PCB) or flexible printed circuits (FPC). The PCB or FPC is then used to mechanically support and electrically connect the antenna to the electronics of the device deploying the antenna using conductive pathways. tracks or signal traces etched from copper sheets, for example, that has been laminated onto a non-conductive substrate. The printed piece can then be mounted either at the top of the handset backside or at the bottom of the front side of the handset. Thus, antennas 100 according to this disclosure can be manufactured, for example, using a standard low-cost technique for the fabrication of a single-side printed circuit board. Other manufacturing techniques may be used without departing from the scope of the disclosure.

Techniques for manufacturing antennas include determining which materials, processes will be followed. For example, a printed circuit board (PCB), an electrically thin dielectric substrate (e.g., RT/diroid 5880), Flame Retardant 4 (FR-4) material complying with the UL-94-V0, or any suitable non-conductive board can be used as the substrate. A conductive layer is provided from which the antenna will be formed. The conductive layer is generally copper, but other materials can be used without departing from the scope of the disclosure. For example, aluminum, chrome, and other metals or metal alloys can be used.

Data for identifying a configuration for the antenna layer is provided which can then be placed onto an etch resistant film that is placed on the conductive layer which will form the antenna. A traditional process of exposing the conductive layer, and any other areas unprotected by the etch resistant film, to a chemical that removes the unprotected conductive layer, leaving the protected conductive layer in place. As will be appreciated by those skilled in the art, newer processes that use plasma/laser etching instead of chemicals to remove the conductive material, thereby allowing finer line definitions, can be used without departing from the scope of the disclosure.

Multilayer pressing can also be employed which is a process of aligning the conductive material and insulating dielectric material and pressing them under heat to activate an adhesive in the dielectric material to form a solid board material. In some instances, holes can be drilled for plated through applications and a second drilling process can be used for holes that are not to be plated through.

Plating, such as copper plating, can be applied to pads, traces, and drilled through holes that are to be plated through. The antenna boards can then be placed in an electrically charged bath of copper. A second drilling can be performed if required. A protective masking material can then be applied over all or select portions of the bare conductive material. The insulation protects against environmental damage, provides insulation, and protects against shorts. Coating can also be applied, if desired. As a final step, the markings for antenna designations and outlines can be silk-screened onto the antenna. Where multiple antennas are manufactured from a panel of identical antennas, the antennas can be separated by routing. This routing process also allows cutting notches or slots into the antenna if required.

As will be appreciated by those skilled in the art, a quality control process is typically performed at the end of the process which includes, for example, a visual inspection of the antennas. Additionally, the process can include the process of inspecting wall by cross-sectioning or other methods. The antennas can also be checked for continuity or shorted connections by, for example, applying a voltage between various points on the antenna and determining if a current flow occurs. The correct impedance of the antennas at each frequency point can be checked by connecting to a network analyzer.

IV. Kits

The antennas disclosed herein can be made available as part of a kit. The kit comprises, for example, a planar antenna comprising a substrate a conductive layer attached to a first surface of the substrate wherein the conductive layer further comprises an antenna section which includes a ground section having an upper, shorter and generally horizontal section and a lower, longer generally horizontal section connected at one end by a vertical segment, and a radiation section having a substantially mirror image shape as the ground section. Additionally, the kit may include, for example, suitable mounting material, such as 3M adhesive transfer tape. Other components can be provided in the kit as well to facilitate installation of the antenna in a target device, such as a flexible cable. The kit can be packaged in suitable packaging to allow transport. Additionally, the kit can include multiple antennas, such that antennas and cables are provided as 10 packs, 50 packs, 100 packs, and the like.

V. Examples

Figure 5:
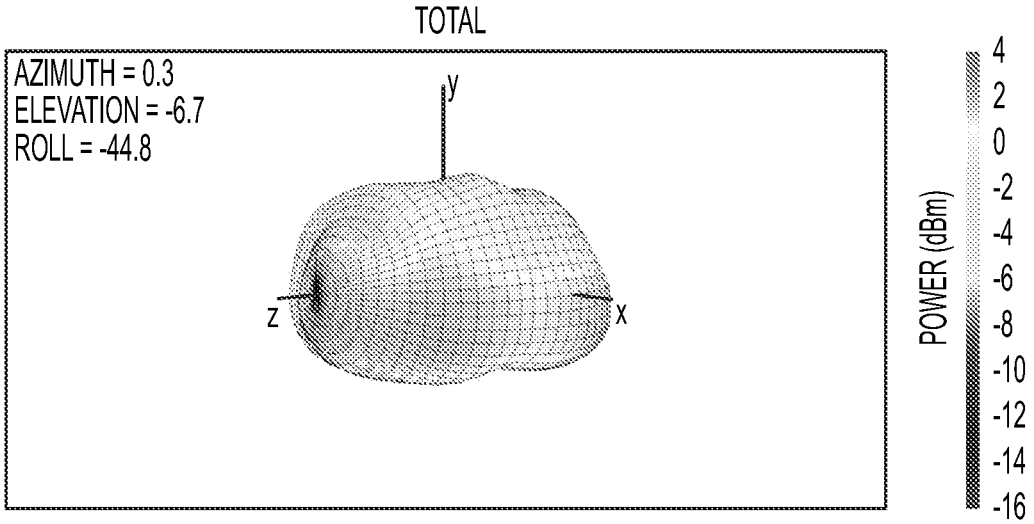
FIG. 5 shows the gain characteristic of the antenna of FIGS. 1*a-e* working under the 2.4 GHz Wi-Fi mode.
Figure 6:
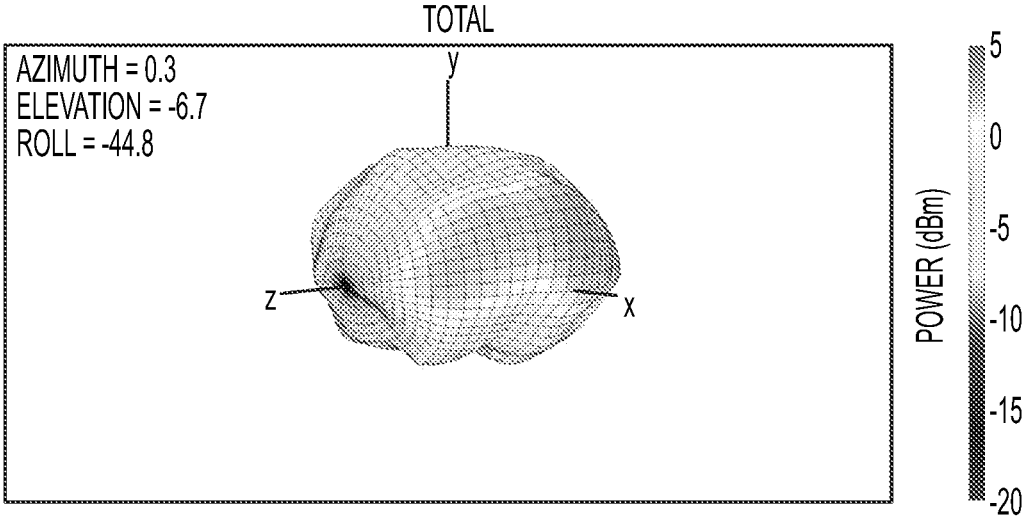
FIG. 6 shows the gain characteristic of the antenna of FIGS. 1*a-e* working under the 5 GHz Wi-Fi mode.

Experimental antennas according to this disclosure have been constructed and tested. FIG. 5 shows an actual measured gain characteristic of an embodiment of an antenna 100 operating in the 2.4 GHz Wi-Fi mode, and FIG. 6 shows a gain characteristic of the same antenna operating in the 5 GHz Wi-Fi mode. Antenna 100 was tested in a lab with an antenna 100 orientation as described in FIG. 4. TABLE 1 lists the performance specification of the antenna measured in FIGS. 5 and 6.

TABLE 1

SPECIFICATION OF AN EXPERIMENTAL ANTENNA

| Standard | Bluetooth | 2.4 GHz Wi-Fi | 5 GHz Wi-Fi | Other 5 GHz |
|---|---|---|---|---|
| Band (MHz) | 2,401-2,480 | 2,400-2,500 | 5,725-5,825 | 4,900-5,900 |
| Peak Gain (dBi) | 3 | 3 | 3 | 3 |
| Average Gain | −2~−3 | | −2~−3 | |
| Efficiency (%) | 70-80% | | 65-80% | |

As discussed above, the gain of the antenna is closely linked to the surface area or volume of the antenna. Moreover, the antenna efficiency directly relates to the actual measured radiated power and sensitivity of the wireless device it is placed into (the TRP/TIS results). The higher the efficiency, given a well matched antenna and device, the better the range and sensitivity of the device, the higher the data transfer speed, and the less power is consumed by the device. For antennas built under the designs disclosed herein, the efficiency remains high in both the 2.4 GHz and 5 GHz ranges, given the relatively small size of the antenna.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A planar antenna comprising:

a substrate;

a conductive layer having a top side and a bottom side wherein the bottom side is attached to a first surface of the substrate wherein the conductive layer further comprises an antenna section wherein the antenna section forms a radiation section having an antenna first truncated arrowhead section, an antenna second tapered rectangular section forming a partial right triangle connected to the antenna first truncated arrowhead section via an antenna perpendicular arm section; and a ground section forming a ground element wherein the ground element has a ground first truncated arrowhead section, a ground second tapered rectangular section connected to the ground first truncated arrowhead section via a ground perpendicular arm section further wherein the ground section has a first aperture defining a ground access point exposing a portion of the ground element in the perpendicular arm.

2. The antenna of claim 1 wherein each of the antenna section and the ground section is a layer of patterned foil adhered to the first surface of the substrate.

3. The antenna of claim 1 wherein the antenna section and the ground section have a combined overall width of from about 30 mm to 58 mm and a height of from about 3 mm to about 15 mm.

4. The antenna of claim 1 wherein the antenna section and the ground section have a combined overall width of from about 42 mm and a height of about 7 mm.

5. The antenna of claim 1 wherein the antenna section and the ground section are adhered to the substrate and have a combined overall thickness of from about 0.05 mm to about 0.15 mm.

6. The antenna of claim 1 wherein the antenna section and the ground section are adhered to the substrate and have a combined overall thickness of about 0.1 mm.

7. The antenna of claim 1 wherein the substrate is at least one of a Flame Retardant 4 material, a flexible printed circuit substrate, and a single-side printed circuit board substrate.

8. The antenna of claim 1 wherein the conductive layer is selected from the group comprising copper, aluminum, nickel, silver, and chrome.

9. The antenna of claim 1 further comprising an insulation layer on top of the conductive layer.

10. The antenna of claim 9 wherein the insulation layer has an aperture defining a feed point exposing a portion of the radiation element.

11. The antenna of claim 1 wherein the dual band includes a first frequency from 2400-2500 MHz and a second frequency from 4900-6000 MHz.

12. A planar antenna manufactured by patterning a substrate comprising a dielectric layer, and a conductive layer applied to at least one surface of the substrate, comprising:

a conductive layer attached to a first surface of the substrate wherein the conductive layer further comprises an antenna section, wherein the antenna section forms a radiation section having an antenna first truncated arrowhead section, an antenna second tapered rectangular section forming a partial right triangle connected to the antenna first truncated arrowhead section via an antenna perpendicular arm section; and a ground section.

13. The antenna of claim 12 wherein each of the antenna section and the ground section is a layer of patterned foil adhered to the first surface of the substrate.

14. The antenna of claim 12 wherein the antenna section and the ground section have a combined overall width of from about 30 mm to 58 mm and a height of from about 3 mm to about 15 mm.

15. The antenna of claim 12 wherein the antenna section and the ground section have a combined overall width of from about 42 mm and a height of about 7 mm.

16. The antenna of claim 12 wherein the antenna section and the ground section adhered to the substrate have a combined overall thickness of from about 0.05 mm to about 0.15 mm.

17. The antenna of claim 12 wherein the antenna section and the ground section adhered to the substrate have a combined overall thickness of about 0.1 mm.

18. The antenna of claim 12 wherein the substrate is at least one of a Flame Retardant 4 material, a flexible printed circuit substrate, and a single-side printed circuit board substrate.

19. The antenna of claim 12 wherein the conductive layer is selected from the group comprising copper, aluminum, nickel, silver, and chrome.

20. The antenna of claim 12 further comprising an insulation layer on top of the conductive layer.

21. The antenna of claim 20 wherein the insulation layer has an aperture defining a ground access point exposing a portion of the ground element.

22. The antenna of claim 20 wherein the insulation layer has an aperture defining a feed point exposing a portion of the radiation element.

23. The antenna of claim 12 wherein the dual band includes a first frequency from 2400-2500 MHz and a second frequency from 4900-6000 MHz.

24. An antenna kit comprising:

a planar antenna comprising:

a substrate;

a conductive layer having a top side and a bottom side wherein the bottom side is attached to a first surface of the substrate wherein the conductive layer further comprises an antenna section wherein the antenna section forms a radiation section having an antenna first truncated arrowhead section, an antenna second tapered rectangular section forming a partial right triangle connected to the antenna first truncated arrowhead section via an antenna perpendicular arm section; and a ground section forming a ground element wherein the ground element has a ground first truncated arrowhead section, a ground second tapered rectangular section forming a partial second right triangle connected to the ground first truncated arrowhead section via a ground perpendicular arm section further wherein the ground section has a first aperture defining a ground access point exposing a portion of the ground element in the perpendicular arm.

25. The kit of claim 24 further comprising a flexible cable adaptable to connect the planar antenna to a target device.

26. The kit of claim 24 further comprising a planar antenna mounting material.

* * * * *